US006227828B1

(12) United States Patent
Takeuchi et al.

(10) Patent No.: US 6,227,828 B1
(45) Date of Patent: May 8, 2001

(54) GEAR PUMP FOR USE IN AN ELECTRICALLY-OPERATED SEALED COMPRESSOR

(75) Inventors: Yoshiharu Takeuchi; Kiyoji Aburaya, both of Otsu; Toshiharu Yasu, Yasu-gun; Masahiro Tsubokawa; Manabu Sakai, both of Kusatsu; Shoji Aoshika, Otsu; Tsutayoshi Narita, Omihachiman, all of (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/476,135

(22) Filed: Jan. 3, 2000

Related U.S. Application Data

(62) Division of application No. 08/864,614, filed on May 28, 1997, now Pat. No. 6,039,551.

(30) Foreign Application Priority Data

Jun. 7, 1996 (JP) ..... 8-145379

(51) Int. Cl.[7] ..... F04C 29/02
(52) U.S. Cl. ..... 418/47; 418/88; 418/89
(58) Field of Search ..... 418/46, 47, 88, 418/89, 94; 184/6.16

(56) References Cited

U.S. PATENT DOCUMENTS

| | | | | |
|---|---|---|---|---|
| 1,834,976 | * | 12/1931 | Schmidt | 418/88 |
| 2,446,194 | | 8/1948 | Samiran | 418/47 |
| 2,596,640 | * | 5/1952 | Berry | 418/88 |
| 2,865,301 | * | 12/1958 | Thomas | 418/47 |
| 2,975,964 | | 3/1961 | Osterkamp | 418/88 |
| 3,088,660 | | 5/1963 | Voggenthaler | 418/88 |
| 3,135,460 | | 6/1964 | Galin | 418/88 |
| 3,260,444 | | 7/1966 | Williams et al. | 418/88 |
| 3,280,940 | * | 10/1966 | Porteous | 418/88 |
| 3,834,843 | * | 9/1974 | Stoltman et al. | 418/88 |
| 5,476,370 | * | 12/1995 | Wood | 418/88 |

FOREIGN PATENT DOCUMENTS

| | | | | |
|---|---|---|---|---|
| 59-060092 | | 4/1984 | (JP) . | |
| 62-13792 | * | 1/1987 | (JP) | 418/89 |
| 62-26394 | * | 2/1987 | (JP) | 418/89 |
| 63-272992 | * | 11/1988 | (JP) | 418/88 |
| 2-030998 | | 2/1990 | (JP) . | |
| 2-86972 | | 3/1990 | (JP) . | |
| 4-214993 | * | 8/1992 | (JP) | 418/94 |
| 5-10281 | * | 1/1993 | (JP) | 418/47 |
| 5-052190 | | 3/1993 | (JP) . | |
| 5-21190 | | 3/1993 | (JP) . | |
| 5-21191 | | 3/1993 | (JP) . | |
| 5-36083 | | 5/1993 | (JP) . | |
| 5-164080 | | 6/1993 | (JP) . | |
| 5-312175 | | 11/1993 | (JP) . | |

(List continued on next page.)

*Primary Examiner*—John J. Vrablik
(74) *Attorney, Agent, or Firm*—Wenderoth, Lind & Ponack, L.L.P.

(57) ABSTRACT

A gear pump is used in an electrically-operated sealed compressor. The compressor includes a compression mechanism, an electric motor for driving the compression mechanism, and a crankshaft for transmitting the rotational force of the electric motor to the compression mechanism. The gear pump includes a pair of gears being in mesh with each other, one of which is connected to one end of the crankshaft, and a pump casing accommodating only the pair of gears. The pump casing together with the gear pair is disposed on one side of a cover plate, while other elements constituting the gear pump are disposed on the other side of the cover plate. By this construction, the distance between the gear pair and an auxiliary bearing to which the gear pump is secured can be reduced and, hence, an undesirable whirling of one end portion of the crankshaft can also be reduced.

25 Claims, 16 Drawing Sheets

FOREIGN PATENT DOCUMENTS

| | | | | |
|---|---|---|---|---|
| 5-312176 | | 11/1993 | (JP) . | |
| 6-74015 | | 3/1994 | (JP) . | |
| 6-25583 | | 4/1994 | (JP) . | |
| 6-235387 | * | 8/1994 | (JP) | 418/88 |
| 6-280769 | * | 10/1994 | (JP) | 418/88 |
| 5-312177 | | 11/1994 | (JP) . | |
| 7-208348 | * | 8/1995 | (JP) . | |
| 7-84842 | | 9/1995 | (JP) . | |

* cited by examiner

GEAR PUMP FOR USE IN AN ELECTRICALLY-OPERATED SEALED COMPRESSOR

This application is a divisional application of application Ser. No. 08/864,614, filed May 28, 1997 U.S. Pat. No. 6,039,551.

BACKGROUND OF THE INVENTION

1. Field of the Invention

The present invention relates generally to an electrically-operated sealed compressor such as, for example, a scroll compressor or a rotary compressor for use in air conditioners, refrigerators or the like and, more particularly, to a gear pump mounted in the electrically-operated sealed compressor.

2. Description of Related Art

Conventionally, an electrically-operated sealed compressor such as a scroll compressor or a rotary compressor is generally used in a cooling apparatus for air conditioners, refrigerators, or the like. This kind of conventional compressor is discussed hereinafter taking the case of a scroll compressor.

As shown in FIG. 14, a sealed vessel 10 accommodates a compression mechanism 1, an electric motor 7 including a stator 5 and a rotor 6, a crankshaft 2 for transmitting the rotational force of the electric motor 7 to the compression mechanism 1, a main bearing 3 for supporting one end of the crankshaft 2, and an auxiliary bearing 4*a* having a bearing holder 4 for supporting the other end of the crankshaft 2. The main bearing 3 has a container 11 attached thereto for temporarily collecting oil which has been supplied to the bearing portions for lubrication thereof. The sealed vessel 10 is provided with a suction pipe 8 for sucking in a low-pressure refrigerant gas and a discharge pipe 9 for discharging a high-pressure refrigerant gas compressed by the compression mechanism 1 to the outside of the sealed vessel 10. The crankshaft 2 has a gear pump 150 attached to the end thereof which is supported by the auxiliary bearing 4*a*.

In the above-described construction, when the rotor 6 of the electric motor 7 rotates, the rotational force thereof is transmitted to the compression mechanism 1 by the crankshaft 2, to thereby compress a refrigerant gas. More specifically, the compression mechanism 1 compresses the low-pressure refrigerant gas drawn through the suction pipe 8 into a high-pressure refrigerant gas, which is in turn discharged into a discharge side space 14 defined in the sealed vessel 10. Thereafter, the high-pressure refrigerant gas passes through a communication hole 12 defined in the main bearing 3 and enters an electric motor side space 17. The main current of the high-pressure refrigerant gas passes through a cutout defined in the stator 5 and enters an auxiliary bearing side space 18 before it is eventually discharged into a refrigerating cycle (not shown) through the discharge pipe 9.

On the other hand, the gear pump 150 has a pump casing 151 including a pair of gears 52, a strainer 157, a foreign substance storage chamber 155 for storing foreign substances captured by the strainer 157, and an oil suction nozzle 156. The pump casing 151 is covered with a cover plate 153 fastened thereto by a plurality of, for example four, screws 152, and has a recess 60*a* defined therein so that a gear chamber 60 for accommodating the gear pair 52 therein may be formed by the cover plate 153 and the recess 60*a*. The fastening force of the screws 152 maintains the tightness between the pump casing 151 and the cover plate 153 to ensure sealing properties to the oil and the refrigerant gas.

As shown in FIGS. 15 and 16, the pump casing 151 has an oil well 61 defined therein and adjoining the gear chamber 60 so that the gear pair 52 may be supplied with the oil which serves as lubricating and sealing oil at the starting of the pump. The strainer 157 comprises a stainless screen 157*a* sandwiched between two stainless frames 157*b* and spot-welded thereto, and a plurality of elastic members or pieces 157*c* protruding therefrom. As shown in FIG. 16, when the strainer 157 is mounted in the pump casing 151, the elastic members 157*c* act to bias the strainer 157 against its mounting surface on the pump casing 151 to prevent the foreign substances in the foreign substance storage chamber 155 from entering the gear chamber 60.

The gear pump 150 has an insert formed thereon and inserted into an associated portion of the bearing holder 4, and the pump casing 151 is fastened to its seat formed on the bearing holder 4 by a plurality of (for example two) bolts 154. As shown in FIG. 15, the gear pair 52 is comprised of an outer gear 52*a* and an inner gear 52*b* in mesh with each other. That end of the crankshaft 2 to which the gear pump 150 is attached has a cutout so as to present a generally D-shaped section and is inserted into a center hole of an inner gear 52*b* having a corresponding shape. The driving force of the electric motor 7 is transmitted to the inner gear 52*b* via the D-shaped portion of the crankshaft 2 and that of the inner gear 52*b* to cause the outer and inner gears 52*a* and 52*b* to undergo a mutual rotation for pumping action.

When the compressor is in operation, the lubricating oil in an oil sump 15 formed at a lower portion of the sealed vessel 10 is sucked up into the inside of the gear pump 150 through the oil suction nozzle 156, and is then introduced into the space defined between the outer and inner gears 52*a* and 52*b* after having-passed through the:strainer 157 for filtering of foreign substances contained therein. Thereafter, the lubricating oil is fed into an oil passage 153*b* defined in the cover plate 153 by the pumping action of the gear pair 52, passes through a through-hole defined in the crankshaft 2 along the center line thereof, and is fed to the compression mechanism 1. Most of the lubricating oil acts to lubricate the sliding surfaces of the main bearing 3 and the crankshaft 2 and is then collected in the oil collecting container 11 attached to the main bearing 3. The lubricating oil thus collected in the container 11 is discharged therefrom through a discharge port 11*a* defined therein and drops by its own gravity to return to the oil sump 15 formed at the lower portion of the sealed vessel 10. The remaining oil together with the high-pressure refrigerant gas is discharged from the compression mechanism 1 into the sealed vessel 10 and is separated from the high-pressure refrigerant gas during movement thereof inside the compressor. This lubricating oil also drops by its own gravity to return to the oil sump 15.

According to the above-described conventional compressor, however, because the pump casing includes the strainer, the foreign substance storage chamber, and the oil suction nozzle in addition to the gear pair, the height of the pump casing becomes large in the longitudinal direction of the compressor. The height depends on the size required for mounting the. strainer, the size appropriate to the volume required for the foreign substance storage chamber, and the size appropriate to the diameter of the oil suction nozzle. On the other hand, the gear chamber accommodating the gear pair and formed in the pump casing is covered with the cover plate screwed to the pump casing, thus inevitably elongating the total longitudinal length of the bearing holder and the gear pair.

For these reasons, in the event that the crankshaft undergoes a whirling motion having tilted from the ideal axis of the crankshaft, the gear pair is also affected by the whirling motion of the crankshaft and will undergo an eccentric motion relative to the ideal axis of the crankshaft. More specifically, the inner and outer gears forming the gear pair rotate relative to each other with their gear teeth clashing against each other during rotation of the crankshaft that is then undergoing the whirling motion. Clashing of the gear teeth eventually leads to an abnormal wear of the gear teeth, the wall surface of the gear chamber, the driving portion of the crankshaft for driving the gear pair or the like. It may also generate abnormal sounds during operation of the compressor, resulting in a lowering in performance and also in reliability of the compressor.

To overcome this kind of problem, it is necessary for the conventional compressor to have a relatively large clearance between the gear pair and the gear chamber. In this case, however, the large clearance lowers the sealing properties between the gear pair and the gear chamber, thus reducing the performance of the pump in terms of flow rate and pump head. According to another method of overcoming the above problem, the crankshaft, the bearing holder, and the gear pump are combined with one another after the design tolerances thereof have been strictly determined. This method, however, requires not only highly accurate machining on these elements, but also very careful inspection and management thereof after the machining.

Furthermore, as described previously, because the conventional compressor is provided with the pump casing accommodating or having the strainer, the foreign substance storage chamber, and the oil suction nozzle in addition to the gear pair, the projected area of the pump casing becomes large in the longitudinal direction of the compressor. Also, the large height of the pump casing results in an enlargement in the volume of the entire gear pump.

On the other hand, to prevent the lubricating oil from being discharged, along with a flow of refrigerant gas, to the outside of the compressor, the auxiliary bearing side space is required to have a sufficiently large volume. For this reason, the gear pump should be a small-sized one of a small volume.

In view of this requirement, it is necessary to remove functionally unnecessary pads from the gear pump. To this end, the pump casing and the cover plate become complicated in shape, and screws are frequently used in fastening them. The fastening by the screws generates minute strains in the cover plate which in turn create a minute gap between the pump casing and the cover plate, resulting in a lower sealing properties.

As a result, there arises the problem that the refrigerant gas may enter the gear pump, thus reducing the pump performance in terms of flow rate and then reducing the performance and reliability of the compressor.

On the other hand, when the operation of the compressor is stopped and the compressor is again started, the gear pair must be supplied with oil to ensure lubrication and sealing thereof for a sufficient pump head. To this end, an oil well is provided so as to adjoin the gear chamber in the pump casing, thus creating a discontinuous plane having a cutout on the cylindrical wall of the gear chamber. Accordingly, when the gear pair undergoes a rotating motion to provide a pumping effect, it slides relative to such cutout, thereby causing an abnormal wear of the gear pair and the gear chamber. The worn-out powder (or shavings) thus generated reaches, together with an oil flow, the sliding portions of the compression mechanism and causes seizing thereof. This has a considerably bad influence on the performance and reliability of the compressor. Also, the sliding movement between the gear pair and the cutout generates noise during operation of the compressor.

Moreover, the conventional gear pump employs a screen of a rectangular shape. Accordingly, in an attempt to enhance the capability of capturing foreign substances contained in the oil by increasing the screen area, the total length around the strainer becomes longer as compared with an increase in screen area. As a result of this, the height of the pump casing becomes larger. As described previously, because the pump casing should be thin, a sufficient screen area cannot be ensured.

Also, because the strainer is caused to adhere to the pump casing by the action of the elastic members attached to and protruding from the strainer frame, the adhesive properties of the strainer to the pump casing vary according to a variation of the elastic force of the elastic members.

Furthermore, when the strainer is mounted in the pump casing, the strainer is first inserted into a strainer chamber in the pump casing and an insertion hole is subsequently covered with the cover plate. Because of this arrangement it is likely that a gap is created between the strainer and the cover plate and, hence, the function of the strainer for capturing foreign substances in the oil cannot be completely attained. More specifically, of the foreign substances contained in the oil, very small ones are likely to pass through such gap and reach, along with an oil flow, the sliding portions of the compression mechanism. These very small foreign substances may cause seizing of the sliding portions, which has a very bad influence on the performance of the compressor.

In addition, because horizontal type electrically-operated compressors and vertical type ones differ in the arrangement of the oil sump within the sealed vessel, it is necessary to prepare gear pumps of different specifications wherein the position of an oil suction nozzle differs to ensure sufficient oil pumping from the oil sump up to the gear pump.

SUMMARY OF THE INVENTION

The present invention has been developed to overcome the above-described disadvantages.

It is accordingly an objective of the present invention to provide a highly efficient and highly reliable gear pump for use in an electrically-operated sealed compressor.

Another objective of the present invention is to provide the gear pump of the above-described type which has a simple construction and can be manufactured at a low cost.

In accomplishing the above and other objectives, the gear pump of the present invention comprises a pair of gears being in mesh with each other, one of which is connected to one end of the crankshaft, and a pump casing accommodating only the pair of gears. This construction can make the pump casing thin and, hence, can reduce the distance between the gear pair and an auxiliary bearing to which the gear pump is secured. Accordingly, when the compressor is in operation, whirling of one end portion of the crankshaft is reduced. Thereby clashing of teeth of the gear pair is suppressed. As a result, no abnormal wear occurs on the gear pair, the wall surface of a gear chamber, or a driving portion of the crankshaft for driving the gear pair. Thus abnormal sounds which have been hitherto caused by the clashing of the teeth of the gear pair are reduced.

Advantageously, the pump casing is generally flat and generally oval-shaped, and has a major axis and a minor axis. The pump casing of this shape has a reduced projected area and a reduced volume, and also has a simple contour or outline. Accordingly, when the pump casing is fastened to its support within the compressor by means of screws, no minute strains are produced in the pump casing, making it possible to ensure the sealing properties of the gear pump. Because a sufficient space is created on the auxiliary bearing side within the compressor, it is possible to prevent lubricating oil mixed with a refrigerant flow from being discharged to the outside of the compressor. This results in a gear pump highly efficient in terms of flow rate and in a highly reliable and efficient compressor.

Again advantageously, the pump casing is asymmetric with respect to one of the major and minor axes thereof. The asymmetric configuration prevents the pump casing from being erroneously assembled in the gear pump, thus eliminating an erroneous operation of the gear pump.

In another form of the present invention, a gear pump comprises a pair of gears being in mesh with each other, a cover plate for covering the pair of gears, and an oil suction nozzle disposed on one side of the cover plate so that the cover plate is interposed between the pair of gears and the oil suction nozzle. This construction minimizes whirling of one end portion of the crankshaft, to thereby suppress clashing of teeth of the gear pair.

Conveniently, the oil suction nozzle is a member independent of the other constituent elements. By so doing, whether the compressor is of the vertical type or the horizontal type, the gear pump of the present invention is applicable thereto by replacing only the oil suction nozzle with another one. Accordingly, it is possible to reduce or facilitate the control operation on various parts of the gear pump to thereby enhance the working efficiency.

The gear pump may include a pump cover mounted on the cover plate, wherein the oil suction nozzle is secured to the pump cover. According to this construction, not only can the oil suction nozzle be integrally formed with the pump cover, but the pump casing can also be made thin. Because the distance between the gear pair and the auxiliary bearing is reduced, whirling of one end portion of the crankshaft is also reduced to thereby suppress clashing of teeth of the gear pair.

Conveniently, at least one of the pump cover and the oil suction nozzle is made of a resin, to thereby simplify the shape thereof.

Also conveniently, the pump cover and the oil suction nozzle are integrally formed as a unit.

In a further form of the present invention, a gear pump comprises a pair of gears being in mesh with each other, a cover plate for covering the pair of gears, and a foreign substance storage portion provided on one side of the cover plate for storing therein foreign substances contained in oil. The cover plate is interposed between the pair of gears and the foreign substance storage portion. This construction can make the pump casing thin and can reduce the distance between the gear pair and the auxiliary bearing.

Conveniently, the foreign substance storage portion is provided in the pump cover.

The pump cover may have a recess defined therein for accumulating foreign substances. Because the foreign substances contained in oil and captured by a strainer are accumulated in the recess of the pump cover, the clogging of a strainer screen is reduced.

Preferably, the gear pump includes a permanent magnet mounted in the pump cover. The permanent magnet can positively capture iron-based foreign substances contained in the oil by the action of its magnetic force. Because seizing of sliding portions within the compressor is avoided by preventing the iron-based foreign substances from reaching them, a highly efficient and reliable compressor is provided.

In a still further form of the present invention, a gear pump comprises a pair of gears being in mesh with each other, a cover plate for covering the pair of gears, a pump cover mounted on the cover plate, and an oil storage portion formed by the cover plate and the pump cover. According to this construction, the gear chamber is not required to have a cutout that creates a discontinuous plane on a cylindrical wall thereof. Accordingly, the gear pump of the present invention is free from such a problem inherent in the conventional gear pump that during rotation of the gear pair, an abnormal wear of the gear pair and that of the gear chamber are caused by sliding movement of the gear pair relative to the cutout. The gear pump of the present invention is also free from noise which has been hitherto caused by such sliding movement.

In another form of the present invention, a gear pump comprises a pair of gears being in mesh with each other, a cover plate for covering the pair of gears, and a strainer disposed on one side of the cover plate for capturing foreign substances contained in oil, with the cover plate interposed between the pair of gears and the strainer. This construction can make the pump casing thin and, hence, can reduce the distance between the gear pair and the auxiliary bearing. Thus, making it possible to reduce whirling of one end portion of the crankshaft and suppress clashing of teeth of the gear pair.

Conveniently, the strainer has a center substantially aligned with a longitudinal axis of the crankshaft.

In a further form of the present invention, a gear pump comprises a pair of gears being in mesh with each other and a cover plate for covering the pair of gears. The cover plate has an oil communication port defined therein for introducing oil to the pair of gears. The cover plate also has an oil passage defined therein on one surface thereof for introducing oil having reached the pair of gears to an oil passage defined in the crankshaft along a center line thereof. By this construction, the oil suction nozzle, the strainer, and the foreign substance storage portion are positioned on one side of the cover plate, while the gear pump is positioned on the other side of the cover plate. Accordingly, the distance between the gear pair and the auxiliary bearing can be shortened, thus reducing whirling of one end portion of the crankshaft and suppressing clashing of teeth of the gear pair.

Advantageously, the cover plate is generally flat and generally ovalshaped, and has a major axis and a minor axis. The cover plate of this shape has a reduced projected area and a simple contour or outline. Accordingly, when the cover plate is screwed to its support within the compressor, no minute strains are produced in the cover plate, making it possible to ensure the sealing properties of the gear pump. The provision of a gear pump that is highly efficient in terms of flow rate results in a highly reliable and efficient compressor.

Again advantageously, the cover plate is asymmetric with respect to one of the major and minor axes thereof. The asymmetric configuration prevents the cover plate from being erroneously assembled in the gear pump, thus eliminating an erroneous operation of the gear pump.

It is preferred that the oil communication port is generally crescent-shaped to widely cover an oil inlet portion of the gear pair so that oil sucked up through the oil suction nozzle may be sufficiently introduced to the gear pair.

It is also preferred that the oil inlet portion of the gear pair is aligned with the oil communication port to thereby, positively introduce the oil sucked up through the oil suction nozzle to the gear pair.

The oil communication port and the oil passage may have respective dull corners formed by pressing on opposite surfaces of the cover plate. During pressing, edges of the oil passage are made dull or rounded on that surface of the cover plate to which the pressure of a press is applied. Accordingly, it becomes possible to widen the area of an oil path through which oil sucked up by the gear pump into the oil passage is introduced into the oil passage of the crankshaft. Also, because the oil passage has sharp corners and not dull or rounded corners on that surface of the cover plate which confronts the gear pair, it also becomes possible to minimize communication between the oil inlet portion of the gear pair and the oil passage at a location where the gear pair confronts the cover plate, to thereby ensure the sealing properties. The provision of a gear pump highly efficient in terms of flow rate results in a highly reliable and efficient compressor.

In a still further form of the present invention, a gear pump comprises a pair of gears being in mesh with each other and a generally flat and generally oval-shaped portion adapted to be screwed to a support member in the electrically-operated sealed compressor. The generally flat and generally oval-shaped portion has a major axis and a minor axis. This configuration can reduce the projected area and the volume of the gear pump and can simplify the contour of the gear pump. Accordingly, when the gear pump is screwed to its support within the compressor, no minute strains are produced in the gear pump, making it possible to ensure the sealing properties thereof.

Advantageously, the generally flat and generally oval-shaped portion is asymmetric with respect to one of the major and minor axes thereof. The asymmetric configuration prevents the generally flat and generally oval-shaped portion from being erroneously assembled in the gear pump, thus eliminating an erroneous operation of the gear pump.

The generally flat and generally oval-shaped portion may be the pump casing having the gear pair accommodated therein, the cover plate for covering the gear pair, or part of the pump cover.

In another form of the present invention, a gear pump comprises a plurality of constituent elements adapted to be fastened by two screws to a support member in the electrically-operated sealed compressor. Because the plurality of constituent elements are fastened together by only two screws, no minute strains are produced therein, making it possible to ensure the sealing properties of the gear pump. Furthermore, the screws used to assemble such elements can also be used to fasten the gear pump to the auxiliary bearing and, hence, the number of screws required for assemblage of the gear pump can be considerably reduced, thus simplifying the assembling work.

The plurality of constituent elements include at least one of the pump casing, the cover plate, the pump cover, and a sealing material mounted in the gear pump for sealing it.

In a further form of the present invention, a gear pump comprises a pair of gears being in mesh with each other and a strainer for capturing foreign substances contained in oil which is introduced to the pair of gears. The strainer is of a generally round shape and has a height considerably smaller than a diameter thereof. According to this construction, because the strainer is made thin and round, the screen area can be enlarged relative to that of the screen diameter. By so doing, the screen can have a sufficient area to enhance the capability of capturing foreign substances contained in the oil. Also, the gear pump can be made small and thin so that the distance between the gear pair and the auxiliary bearing can be shortened. Thus, the whirling of one end portion of the crankshaft and the clashing of teeth of the gear pair can be reduced.

Advantageously, the strainer comprises a screen and a generally round resinous frame injection-molded to the screen. The resinous frame has at least one radially extending rib for reinforcement thereof and for support of the screen. By this construction, pads of the resin can be reduced while ensuring the rigidity of the resinous frame. Also, deformation of the strainer which may be caused by strains in the resinous frame or by the pressure of an oil flow acting on the screen can be prevented by reinforcing the resinous frame and by appropriately supporting the screen. Because the screen can have a sufficient area without enlarging the shape and volume thereof, it can efficiently capture foreign substances contained in the oil.

In a still further form of the present invention, a gear pump comprises a pair of gears being in mesh with each other and a strainer for capturing foreign substances contained in oil which is introduced to the pair of gears. The stainer comprises a screen and a resinous frame injection-molded to the screen. According to this construction, the strainer can be made round and thin and can be formed into a simple configuration. Furthermore, the strainer of this construction can be readily manufactured at a low cost.

It is preferred that the resinous frame be molded from a PBT resin containing 10 to 50% of graphite. By so doing, not only can pads the resin be reduced while maintaining the rigidity of the resinous frame, but also the accuracy in shape can be ensured.

It is also preferred that the resinous frame has at least one rib for reinforcement thereof. The rib serves to prevent deformation of the strainer which may be caused by strains in the resinous frame.

Advantageously, the screen is made of stainless steel, brass, or iron. The stainless steal screen has a good resistance to corrosion and a sufficient rigidity, and can be manufactured with ease. The brass screen has a good resistance to corrosion and can be manufactured with ease. The iron screen has a good resistance to corrosion and a sufficient rigidity, and can be machined and manufactured with ease.

The resinous frame may be of a generally round shape having at least one radially extending rib for reinforcement thereof and for support of the screen.

Conveniently, the resinous frame has one end surface facing the crankshaft and spaced a distance away from the screen. By this configuration, when the strainer and the cover plate are held in contact with each other, the screen does not interfere with or is not damaged by projections which have been formed by press-molding the oil passage on the cover plate. As a result, the gear pump can be made thin, and the volume thereof can be reduced. Because a sufficient space is created on the auxiliary bearing side within the compressor, it is possible to prevent lubricating oil mixed with a refrigerant flow from being discharged to the outside of the compressor, resulting in a highly reliable and efficient compressor.

Again conveniently, the resinous frame has a plurality of projections formed on a peripheral surface thereof. When the strainer is press-fitted into the pump cover with a small force or pressure, the projections act to hold the strainer within the pump cover, thus eliminating the use of a special fastening means.

In another form of the present invention, a gear pump comprises a pair of gears meshed with each other, a strainer having a screen and a frame made by press-molding and secured to the screen for capturing foreign substances contained in oil which is introduced to the pair of gears, and a pump cover for covering the strainer press-fitted thereinto. According to this construction, the strainer can be made round and thin and can be formed into a simple configuration. Furthermore, the strainer can be handled together with the pump cover by press-fitting the strainer frame into the pump cover. The strainer frame may be secured to the pump cover by spot welding.

It is preferred that the frame is of a generally round shape having at least one radially extending rib for reinforcement thereof and for support of the screen.

In a further form of the present invention, a gear pump comprises a pair of gears being in mesh with each other, a strainer for capturing foreign substances contained in oil which is introduced to the pair of gears, and a pump cover for covering the strainer. The pump cover has a shoulder portion in which the strainer is received, wherein the strainer has a height greater than that of the shoulder portion so that the strainer protrudes from one end surface of the pump cover. By this construction, when the pump cover together with the cover plate are fastened by the screws with the strainer interposed therebetween, that end face of the strainer which is held in contact with the cover plate acts to ensure the sealing properties between the pump cover and the cover plate.

In a still further form of the present invention, a gear pump comprises a pair of gears being in mesh with each other, a cover plate for covering the pair of gears, a pump cover mounted on the cover plate, and a sealing material interposed between the cover plate and the pump cover. According to this construction, it is sufficient if the cover plate has a somewhat high flatness on only one surface thereof. Even if the other surface of the cover plate is not so flat, the sealing material serves to ensure the sealing properties between the cover plate and the pump cover.

Advantageously, the sealing material is generally flat and generally oval-shaped. This configuration can reduce the projected area of the sealing material and can simplify the contour of the sealing material. Accordingly, when the sealing material together with other elements is screwed to its support within the compressor, no minute strains are produced in the sealing material, making it possible to ensure the sealing properties of the gear pump.

In another form of the present invention, a gear pump comprises a pair of gears being in mesh with each other, and a pump cover for covering the pair of gears. The pump cover has a rib formed on an entire peripheral edge thereof so as to extend towards the crankshaft. Because the rib makes the pump cover, even if the thickness of the pump cover is reduced in an attempt to reduce the volume of the gear pump, the sealing property of the pump cover is fully ensured. Also, the pump cover can be manufactured at a low cost.

Conveniently, a plurality of elements constituting the gear pump are accommodated in a space defined by the rib so that the pump cover and the plurality of elements may be temporarily assembled and handled together during assemblage of the gear pump. Thereby, the working efficiency is enhanced.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on application No. 8-145379 filed in Japan, the content of which is incorporated hereinto by reference.

Figure 1:
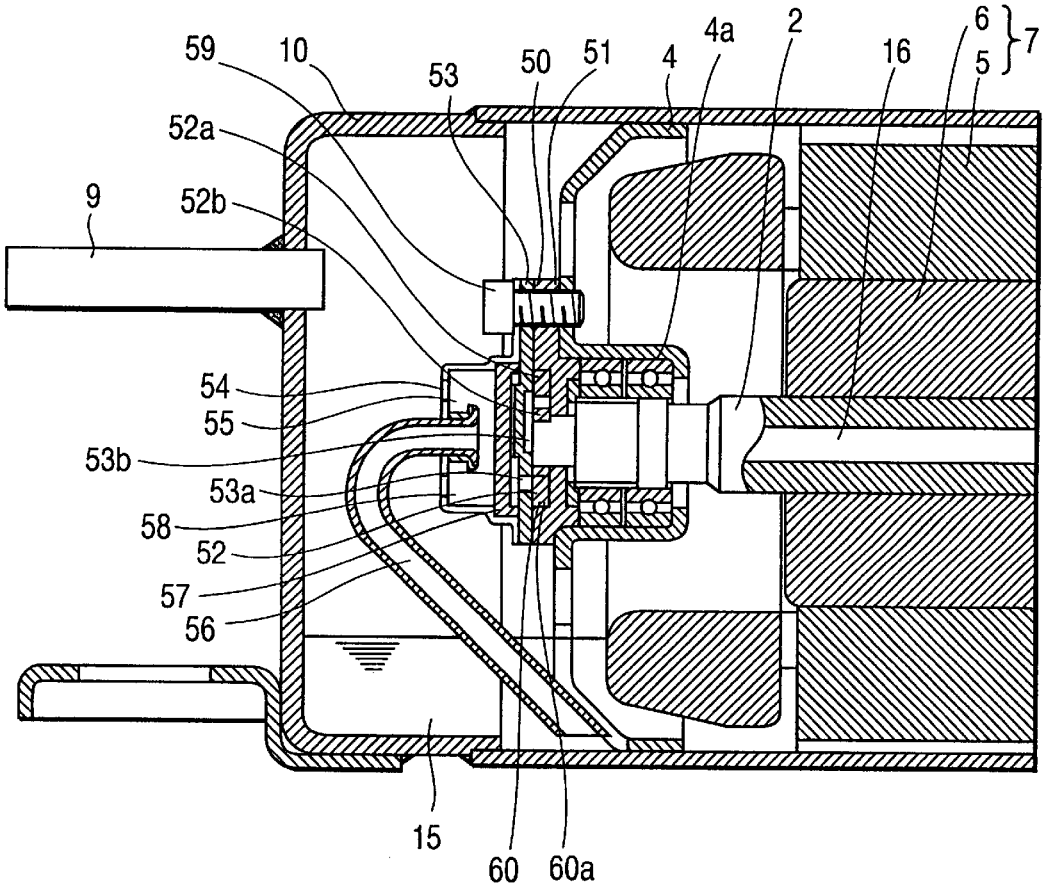
FIG. 1 is a vertical sectional view of that portion of an electrically-operated sealed compressor in which a gear pump according to a first embodiment of the present invention is incorporated.

Referring now to the drawings, there is shown in FIG. 1 a gear pump 50 according to a first embodiment of the present invention, which is incorporated in an electrically-operated sealed scroll compressor comprising a sealed vessel 10, a compression mechanism (not shown) accommodated in the sealed vessel 10, an electric motor 7 including a stator 5 and a rotor 6 for driving the compression mechanism, and a crankshaft 2 for transmitting the rotational force of the electric motor 7 to the compression mechanism. As shown therein, the gear pump 50 comprises a pump casing 51 having an insert formed thereon so as to protrude towards the crank shaft 2. This insert is received in an associated portion of a bearing holder 4 of an auxiliary bearing 4*a*. The pump casing 51 together with a cover plate 53 and a cup-like pump cover 54 is fastened to its seat formed on the bearing holder 4 by means of a plurality of screws 59. The pump casing 51 has a recess 60*a* defined therein in which only a gear pair 52 comprised of an outer (second) gear 52*a* and an inner (first) gear 52*b* in mesh with each other is accommodated. The pump casing 51 together with the gear pair 52 is covered with the cover plate 53 and, hence, a gear chamber 60 in which the gear pair 52 is rotatably mounted is formed by the cover plate 53 and the recess 60*a* of the pump casing 51. The inner (first) gear 52*b* has a generally D-shaped center hole defined therein in which one end of the crankshaft 2 having a corresponding shape is engaged. Therefore, the rotational force transmitted via-the crankshaft 2 may be further transmitted to the inner (first) gear 52*b* to cause the outer and inner gears 52*a* and 52*b* to undergo a mutual rotation for pumping action.

On the other hand, the cover plate 53 has an oil communication port 53a defined therein and is interposed between the gear pair 52 and an oil suction nozzle 56 to introduce oil sucked up through the oil suction nozzle 56 to the gear pair 52. The cover plate 53 also has a recessed oil passage 53*b* defined therein on one surface thereof to introduce the oil having reached the gear pair 52 to an oil passage 16 defined in the crankshaft 2 along the center line thereof. The pump cover 54 is mounted on the cover plate 53 and has a recess defined therein so as to form a foreign substance storage portion 55 and an oil storage portion 58. These storage portions 55 and 58 are delimited by the pump cover 54 and the cover plate 53. The pump cover 54 has a shoulder portion in which a strainer 57 is received having a relatively thin and round frame made of a resin and a screen or meshes made of stainless steel, brass or iron to which the frame is secured, for example, by injection molding. One end face of the resinous frame of the strainer 57 protrudes slightly beyond one end face of the pump cover 54 in a longitudinal direction of the compressor. In other words, the strainer 57 has a height greater than that of the shoulder portion of the pump cover 54. Because of this, when the pump cover 54 together with the cover plate 53 and the pump casing 51 is fastened to the bearing holder 4 by means of screws, the strainer 57 is sandwiched between the shoulder portion of the pump cover 54 and the cover plate 53 with opposite round faces of the strainer 57 held in contact therewith. Accordingly, the strainer 57 adheres to both the pump cover 54 and the cover plate 53.

The cup-like pump cover 54 has a center connection opening defined in a bottom portion thereof with the peripheral lip region thereof inwardly burred (projecting inwardly) to define an inner tube. The oil suction nozzle 56 made of synthetic resin such as Teflon, has one end inserted inwardly into the inner tube (lip portion) integral with the pump cover 54 and held in tight contact with an inner peripheral surface of the inner tube. The tight contact of the oil suction nozzle 56 with the inner surface of the inner tube of the pump cover 54 can be accomplished by heating that end of the oil suction nozzle 56 to allow it to undergo plastic deformation. The other end of the oil suction nozzle 56 is positioned within an oil sump 15 defined at a lower portion of the sealed vessel 10.

The above-construction can shorten the distance between the auxiliary bearing 4*a* and the gear pair 52, compared with the construction of the conventional gear pumps. Accordingly, when the compressor is in operation, whirling of the end portion of the crankshaft 2 is reduced and, hence, the gear pair 52 mounted thereon smoothly rotates without causing clashing of its teeth within the gear chamber 60. As a result, no abnormal wear occurs on the gear pair 52 or the wall surface of the gear chamber 60, and abnormal sounds are not generated which have been hitherto caused by rotation of the gear pair 52.

When the gear pump of the above-described construction is in operation, the oil flows as follows.

When the gear pump 50 is in operation, the pumping action of the gear pair 52 introduces oil stored in the oil sump 15 into the foreign substance storage portion 55 by sucking oil through the oil suction nozzle 56. Because the strainer 57 received in the shoulder portion of the pump cover 54 is positioned so as to cover the oil communication port 53*a*; foreign substances contained in the oil are captured by the strainer 57 when the oil is sucked up by the gear pair 52 through the oil communication port 53*a*. The oil thus sucked up by the gear pair 52 passes through the oil passage 53*b* of the cover plate 53 and is introduced into the oil passage 16 of the crankshaft 2 before it is eventually supplied to the compression mechanism 1.

Figure 2:
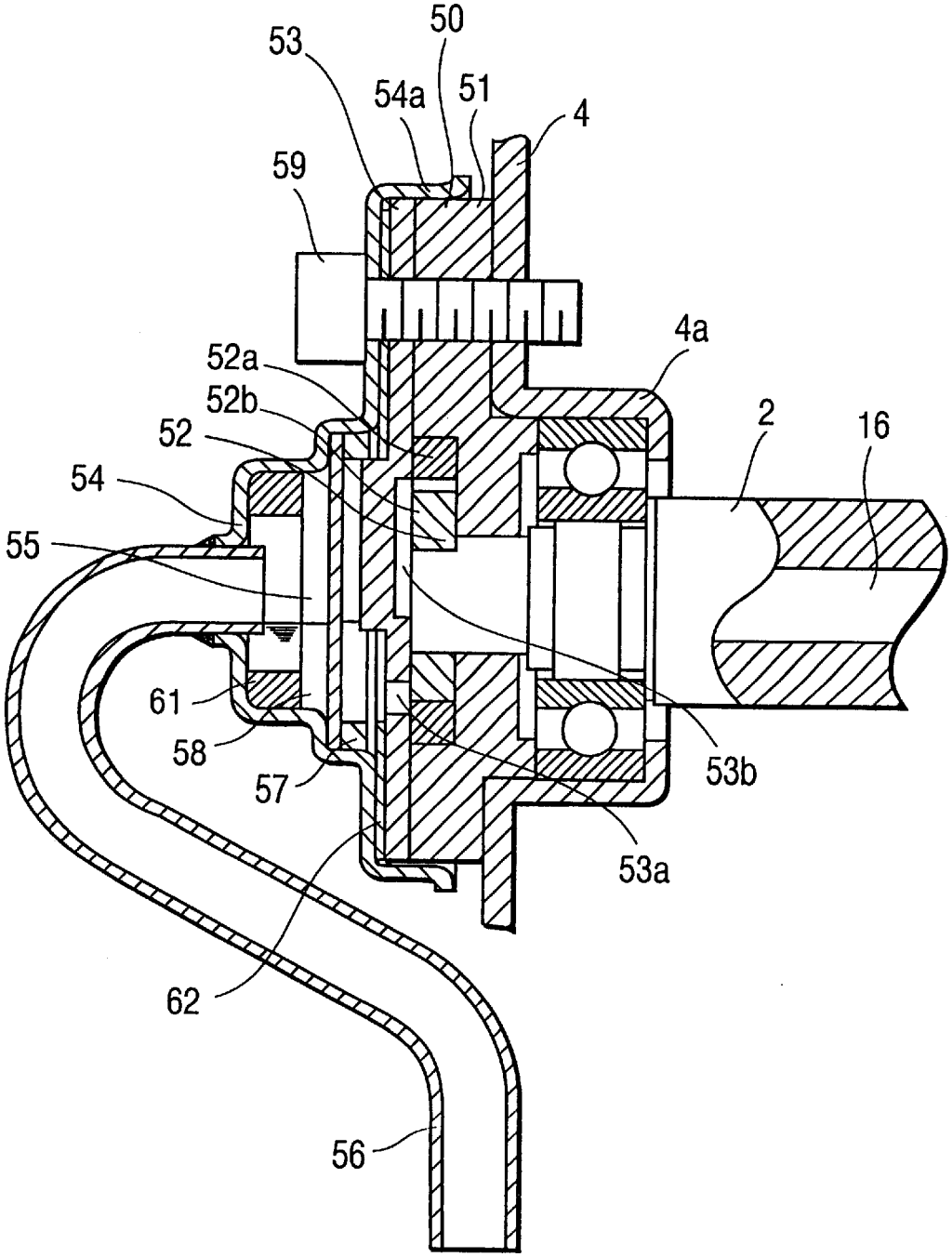
FIG. 2 is a vertical sectional view of a gear pump according to a second embodiment of the present invention.
Figure 3:
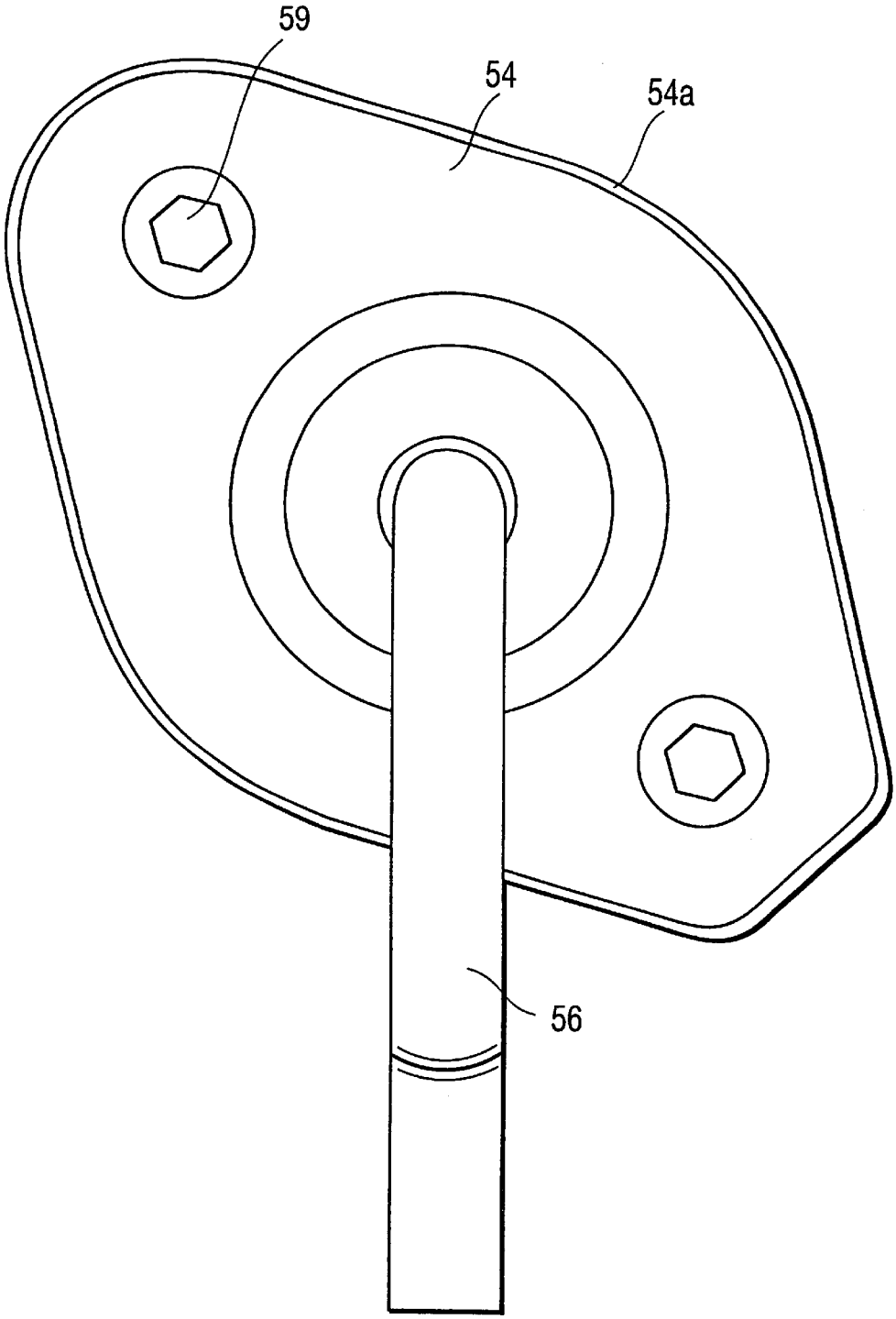
FIG. 3 is a side view of the gear pump of FIG. 2.

FIGS. 2 and 3 depict a gear pump 50 according to a second embodiment of the present invention. The function of the gear pump 50 and the oil flow are substantially the same as those in the first embodiment referred to above.

In FIGS. 2 and 3, the pumping action of the gear pair 52 introduces oil into the foreign substance storage portion 55 formed in the pump cover 54 by sucking oil through the oil suction nozzle 56. The oil then passes through the oil communication port 53*a* defined in the cover plate 53 and reaches the gear pair 52. The oil storage portion 58 is formed by the pump cover 54 and the cover plate 53. Therefore, even when the gear pump 50 is stopped by stopping the compressor and is again started, the gear pair 52 is supplied with the oil accommodated in the oil storage portion 58 for lubrication and sealing thereof. Thus, pump performance in terms of flow rate is insured.

Furthermore, a permanent magnet 61 is mounted in the pump cover 54 to positively capture, by the action of its magnetic force, iron-based foreign substances contained in the oil introduced thereinto so that such foreign substances may be stored in the foreign substance storage portion 55 . The pump cover 54 has a rib 54*a* formed on the entire peripheral edge thereof so as to extend towards the crankshaft 2. Accordingly, even if the pump cover 54 is made thin, the rib 54*a* makes it rigid, thus ensuring the-sealing properties between it and the cover plate 53. Also, a sealing material 62 is interposed between the pump cover 54 and the cover plate 53 to enhance the sealing properties therebetween.

Moreover, each of the pump casing 51, the cover plate 53, the sealing material 62, and the pump cover 54 has a flange-shaped external form. More specifically, the pump casing 51, the cover plate 53, and the sealing material 62 are generally flat and generally oval-shaped and have a major axis and a minor axis perpendicular to each other, while the pump cover 54 has a generally flat and generally oval-shaped portion having a major axis and a minor axis perpendicular to each other. Accordingly, in assembling the gear pump 50, these elements can be simultaneously fastened to the bearing holder 4 using two screws 59. Consequently, a decrease in sealing properties at the sealing surfaces generally caused by minute strains produced in the pump cover 54 or the cover plate 53 during fastening, can be minimized. Also, because the external form of the gear pump 50 is simplified, it can be made small. In the case where part of the flange-shaped external form is odd- or irregular-shaped, (i.e., the pump casing 51, the cover plate 53, the pump cover 54, or the sealing material 62 is asymmetric with respect to one of the major and minor axes thereof, as shown in FIG. 3), an error in the direction in which each element is mounted can be prevented during assemblage of the gear pump 50. Accordingly, generation of a serious defect such as, for example, the reverse pumping action which occurs when the pump casing 51 is rotated 180° from its proper position when mounted on the bearing holder 4, can be prevented.

In addition, if temporary assemblage is carried out by slightly press-fitting the cover plate 53 into the pump cover 54 with the permanent magnet 61, the strainer 57 and the sealing material 62 accommodated within the rib 54*a* of the pump cover 54, these elements can be handled together during assemblage, thus enhancing the working efficiency.

Figure 4:
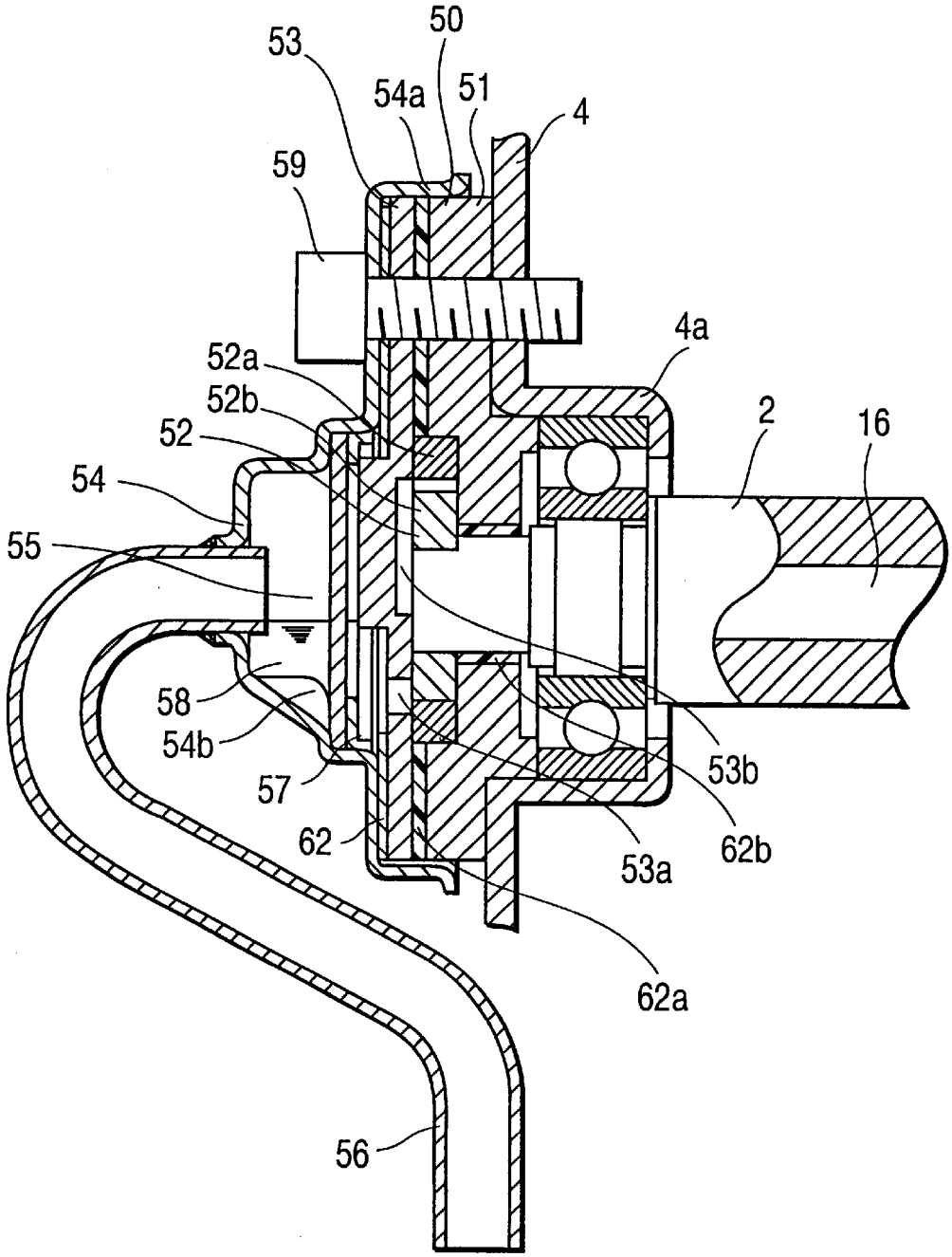
FIG. 4 is a view similar to FIG. 2, but according to a third embodiment of the present invention.

FIG. 4 depicts a gear pump 50 according to a third embodiment of the present invention. As shown therein, the gear pump 50 comprises a sealing material 62*a* interposed between the cover plate 53 and the pump casing 51, and another sealing material 62*b* interposed between the pump casing 51 and the crankshaft 2. These sealing materials 62*a* and 62*b* act to enhance the sealing properties of the gear pump 50. The pump cover 54 has a recess 54*b* defined therein at a lower portion thereof for accommodating foreign substances. This recess 54*b* acts to reduce clogging of the screen of the strainer by accumulating therein the foreign substances contained in the oil and captured by the strainer. In this embodiment, the strainer frame may be made of a metal and manufactured by a press operation. In this case, it is sufficient if the screen is sandwiched between the pump cover 54 and the strainer frame, with the strainer frame secured to the pump cover 54 by spot-welding or press-fitting.

Figure 5A:
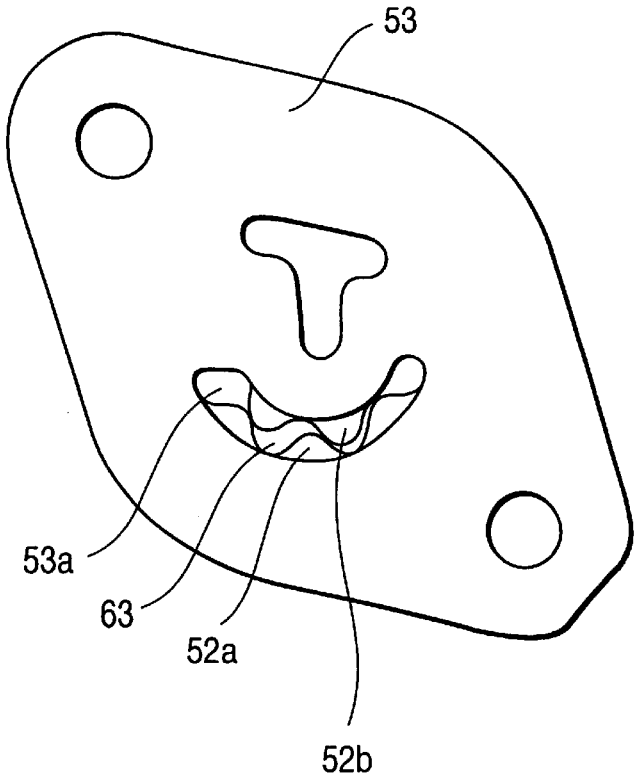
FIG. 5A is a vertical sectional view of an essential portion of a gear pump according to a fourth embodiment of the present invention.
Figure 5B:
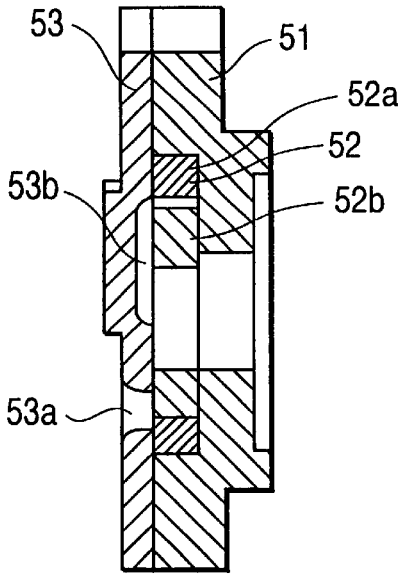
FIG. 5B is a side view of the gear pump of FIG. 5A.

FIGS. 5A and 5B depict part of a gear pump 50 according to a fourth embodiment of the present invention. As shown therein, the oil is readily introduced into the gear pair 52 by aligning an oil inlet portion 63 of the gear pair 52 with the oil communication port 53*a* of the cover plate 53. The oil communication port 53*a* is generally crescent-shaped to widely cover the oil inlet portion 63 of the gear pair 52. This configuration can sufficiently reduce the resistance of the oil communication port 53*a* when the oil passes therethrough, making it possible to reduce the rotation load of the gear pump 50. Furthermore, when the direction in which the cover plate 53 receives the pressure of a press during formation of the oil communication port 53*a* is made counter to the direction in which the cover plate 53 receives the pressure of the press during formation of the oil passage 53*b*, the oil communication port 53*a* and the oil passage 53*b* can have respective dull or rounded corners on opposite surfaces of the cover plate 53, as shown in FIG. 5B. By so doing, it becomes possible to widen the area of an oil path through which oil in the oil passage 53*b* is introduced into the oil passage 16 of the crankshaft 2. It also becomes possible to minimize communication between the oil inlet portion 63 of the gear pair 52 and the oil passage 53*b* at a location where the gear pair 52 confronts the cover plate 53, to thereby ensure the sealing properties.

Figure 6:
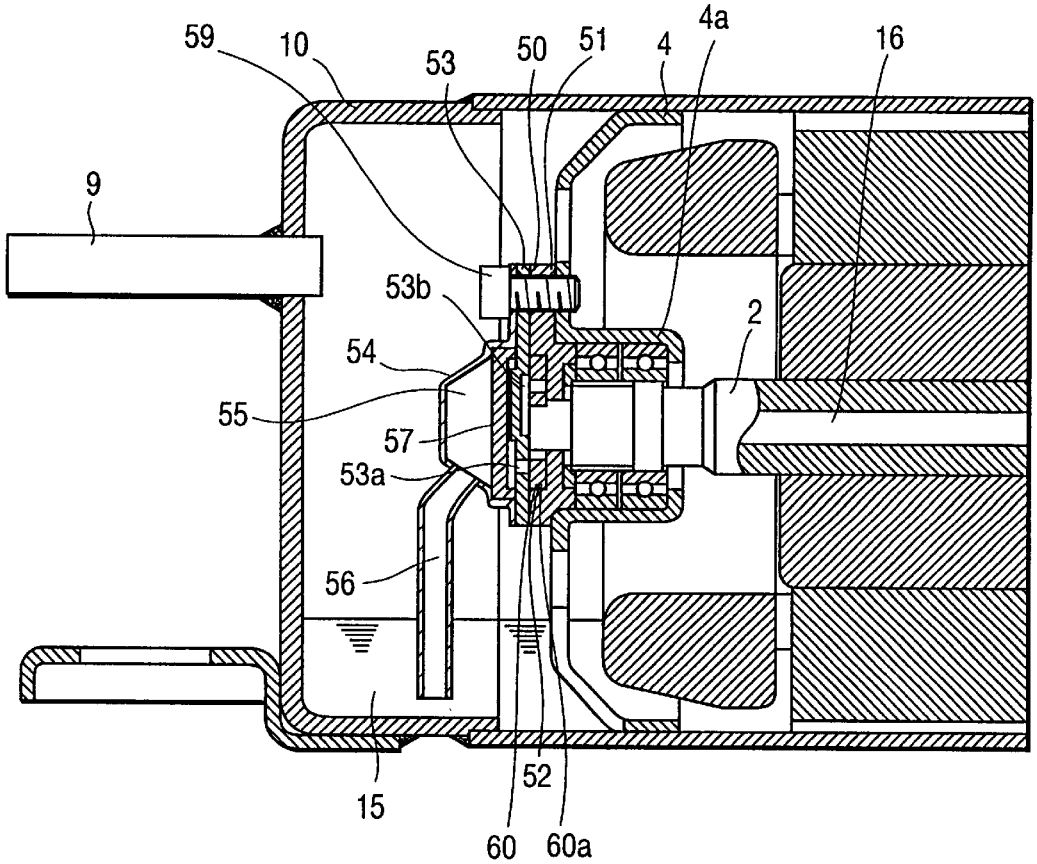
FIG. 6 is a view similar to FIG. 1, but particularly depicting a modification of a pump cover of the gear pump.

As shown in FIG. 6, the pump cover 54 may have a slope formed at a bottom portion thereof and an oil suction nozzle 56 integrally formed or processed therewith so as to extend obliquely downwardly therefrom.

Figure 7:
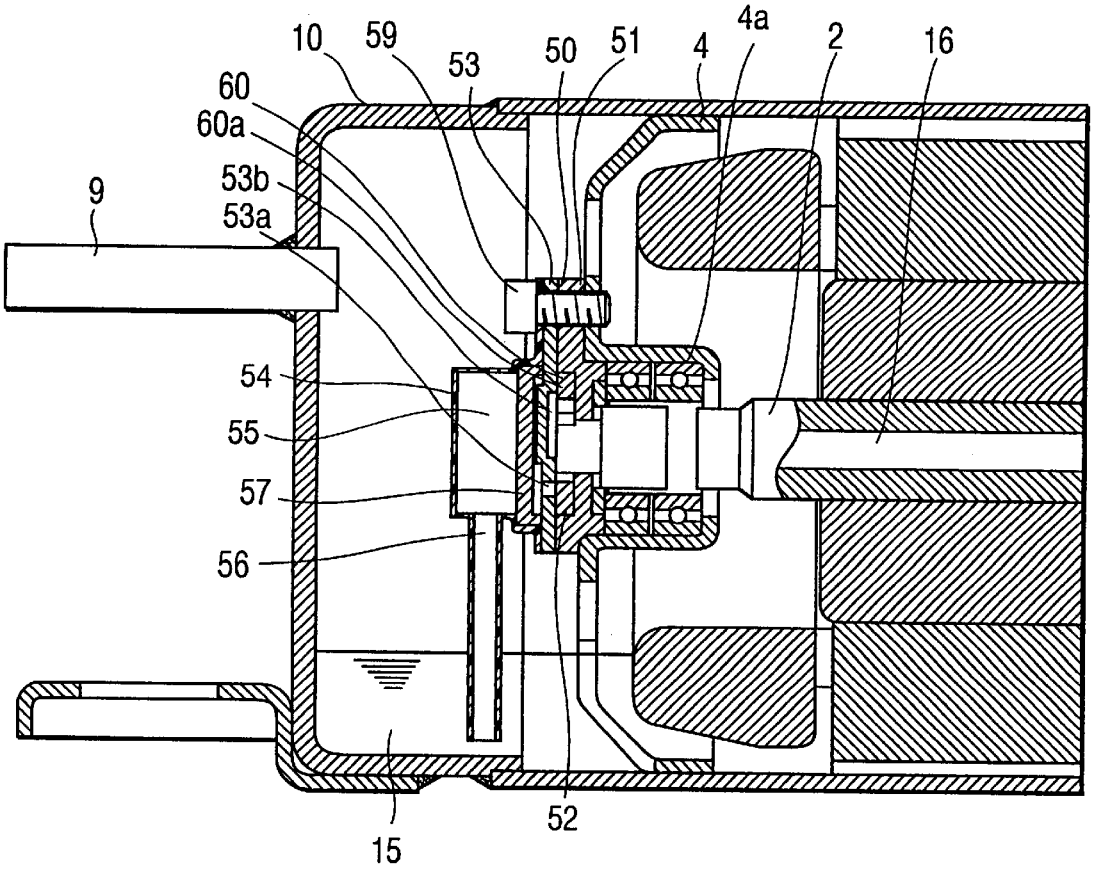
FIG. 7 is a view similar to FIG. 1, but particularly depicting another modification of the pump cover.

Also, as shown in FIG. 7, the pump cover 54 may be made of a resin having an oil suction nozzle 56 integrally formed therewith so as to extend downwardly therefrom.

Figure 8A:
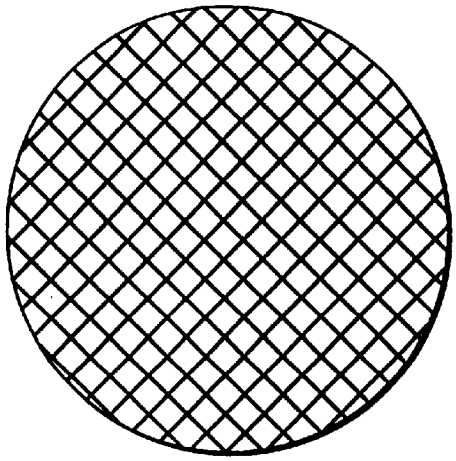
FIG. 8A is a front view of a strainer mounted in the gear pump shown in FIGS. 1, 6, or 7.
Figure 8B:
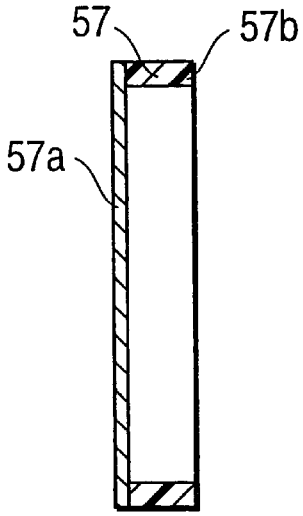
FIG. 8B is a vertical sectional view of the strainer of FIG. 8A.

FIGS. 8A and 8B depict a strainer 57 comprising a cylindrical resinous frame 57*b* and a screen or meshes 57*a* secured to one end thereof.

Figure 9A:
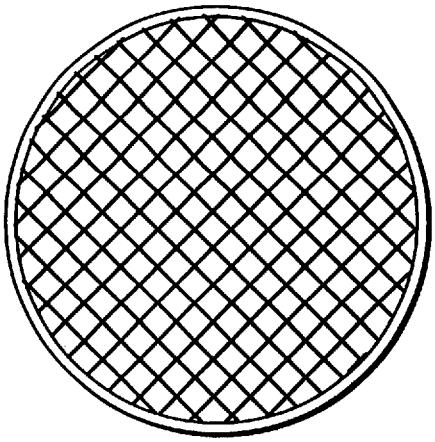
FIG. 9A is a view similar to FIG. 8A, but depicting a modification thereof.
Figure 9B:
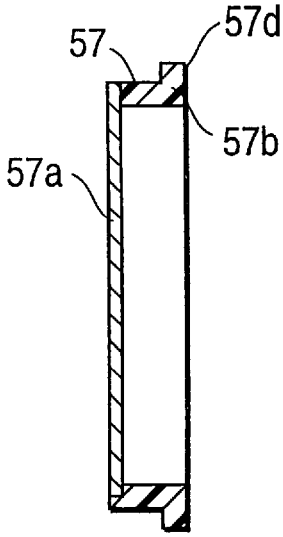
FIG. 9B is a vertical sectional view of the strainer of FIG. 9A.

FIGS. 9A and 9B depict a modification of the strainer 57 having a rib 57*d* integrally formed with the cylindrical resinous frame 57*b* and extending outwardly from the other end thereof to make the strainer 57 rigid.

Figure 10A:
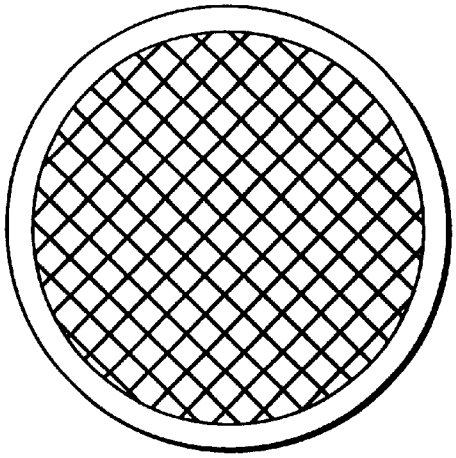
FIG. 10A is a view similar to FIG. 8A, but depicting another modification thereof.
Figure 10B:
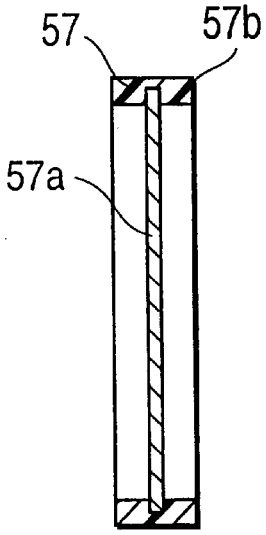
FIG. 10B is a vertical sectional view of the strainer of FIG. 10A.

FIGS. 10A and 10B depict another modification of the strainer 57 in which the screen 57*a* is secured to the internal surface of the cylindrical resinous frame 57*b* at a central portion thereof.

Figure 11A:
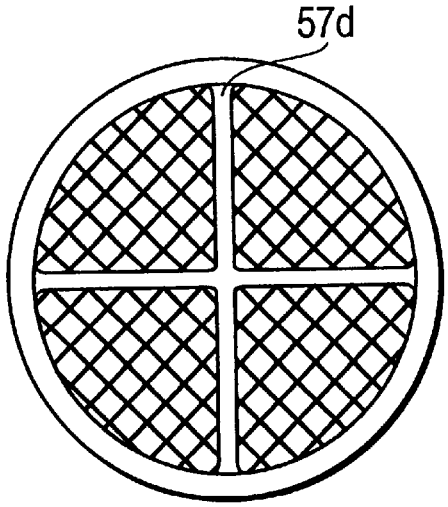
FIG. 11A is a view similar to FIG. 8A, but depicting a further modification thereof.
Figure 11B:
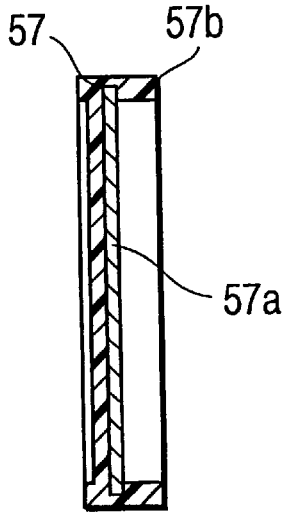
FIG. 11B is a vertical sectional view of the strainer of FIG. 11A.

FIGS. 11A and 11B depict a further modification of the strainer 57 having a radially extending cross-shaped rib 57*d* integrally formed with the cylindrical resinous frame 57*b* to make the strainer 57 rigid and support the screen 57*a*.

Figure 12A:
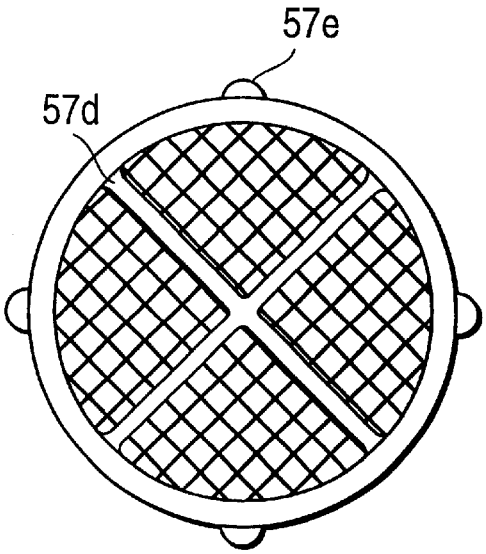
FIG. 12A is a view similar to FIG. 8A, but depicting a still further modification thereof.
Figure 12B:
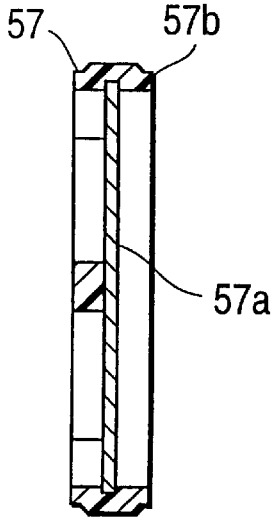
FIG. 12B is a vertical sectional view of the strainer of FIG. 12A.

FIGS. 12A and 12B depict a still further modification of the strainer 57 having a plurality of (for example four) small projections 57*e* integrally formed with the cylindrical resinous frame 57*b* and extending outwardly therefrom. When the strainer 57 is slightly press-fitted into the pump cover 54, the projections 57*e* act to hold the former in the latter.

In each of the strainers 57 shown in FIGS. 8–12, because the screen 57*a* is spaced apart from that end face of the cylindrical resinous frame 57*b* which is held in contact with the cover plate 53, during assemblage the screen 57*a* does not interfere with or is not damaged by projections which have been formed by press-molding the oil passage 53*b* on the cover plate 53. Also, each of the strainers 57 shown in FIGS. 8–12 has a height considerably smaller than the diameter thereof.

It is preferred that the cylindrical frame be made of PBT resin containing 10–50% graphite. An increase in rigidity of the cylindrical resinous frame makes it possible to reduce pads thereof and enhance the accuracy in shape during molding.

Figure 13:
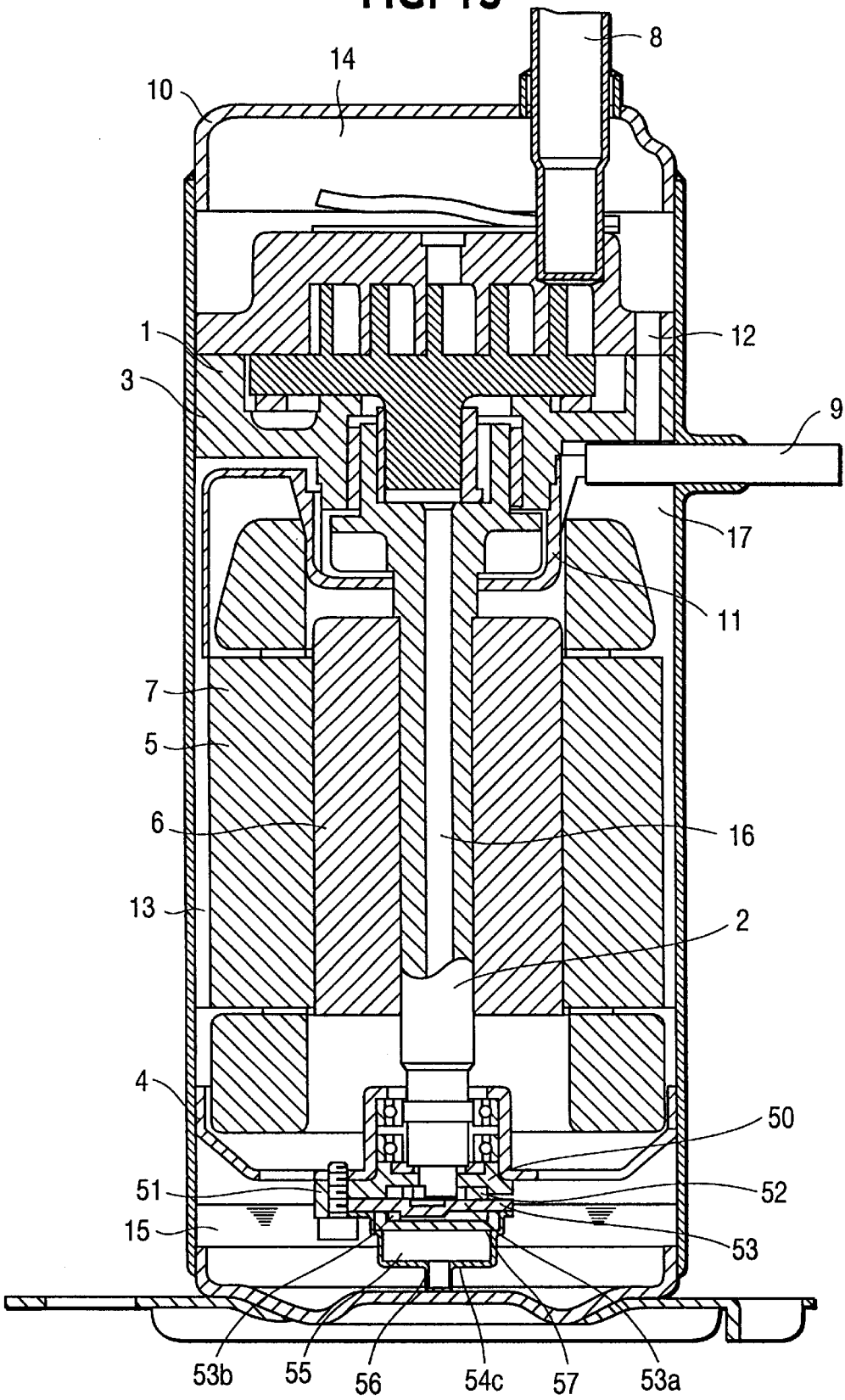
FIG. 13 is a vertical sectional view of a vertical type electrically-operated sealed compressor in which the gear pump of the present invention is incorporated.
Figure 14:
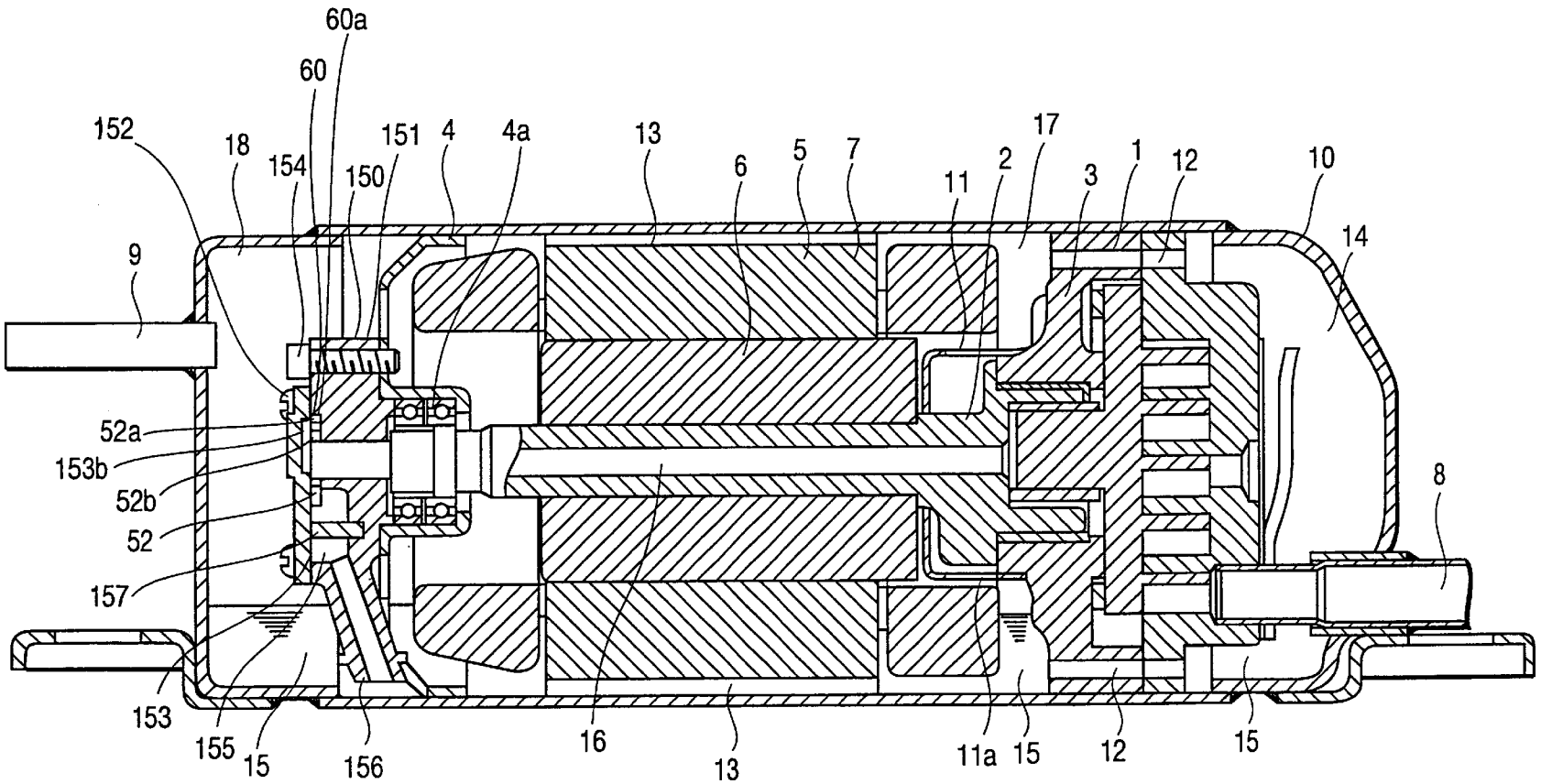
FIG. 14 (PRIOR ART)
FIG. 14 is a vertical sectional view of a conventional electrically-operated sealed scroll compressor.
Figure 15:
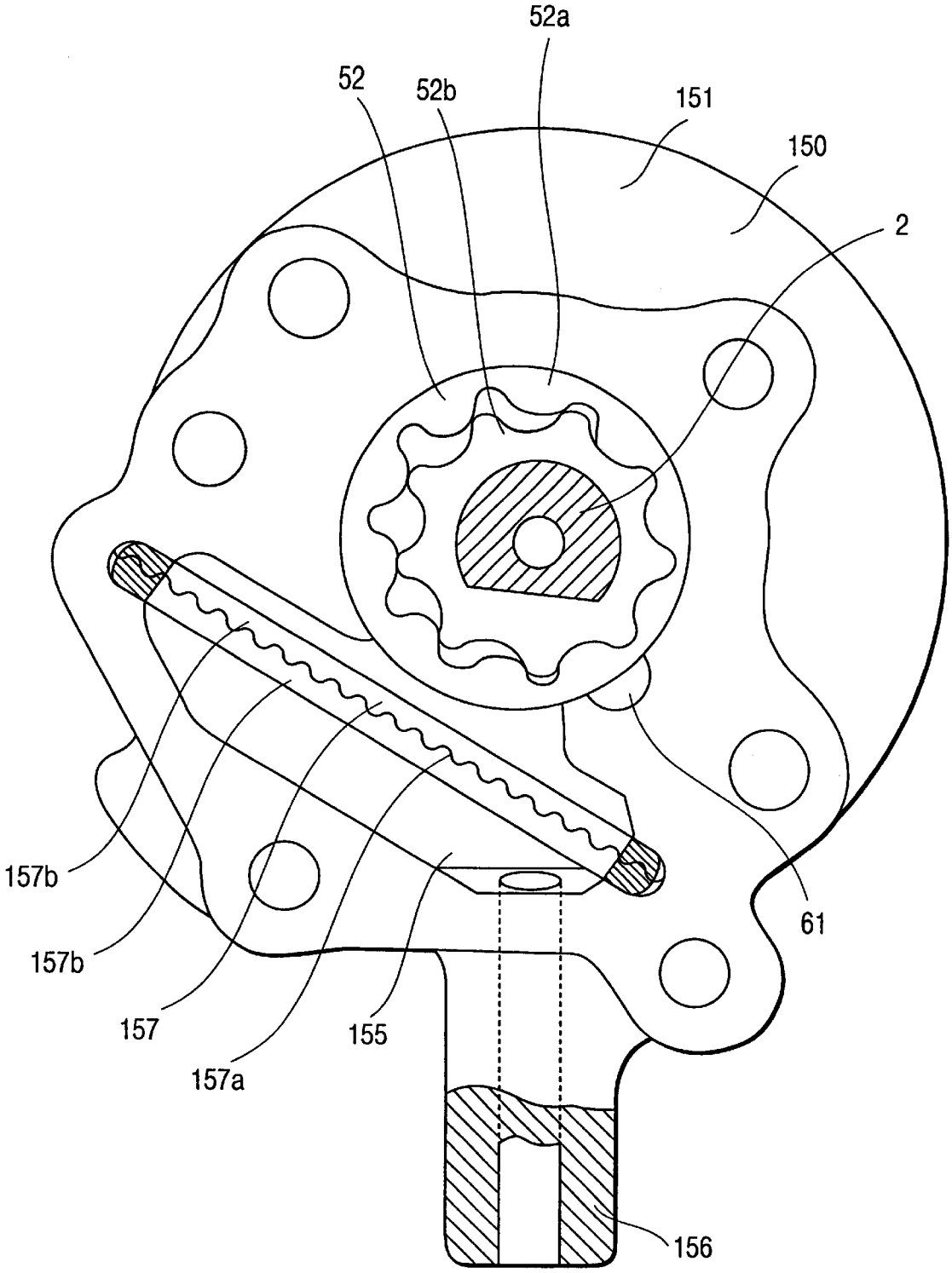
FIG. 15 (PRIOR ART)
FIG. 15 is a front view of a conventional gear pump.
Figure 16:
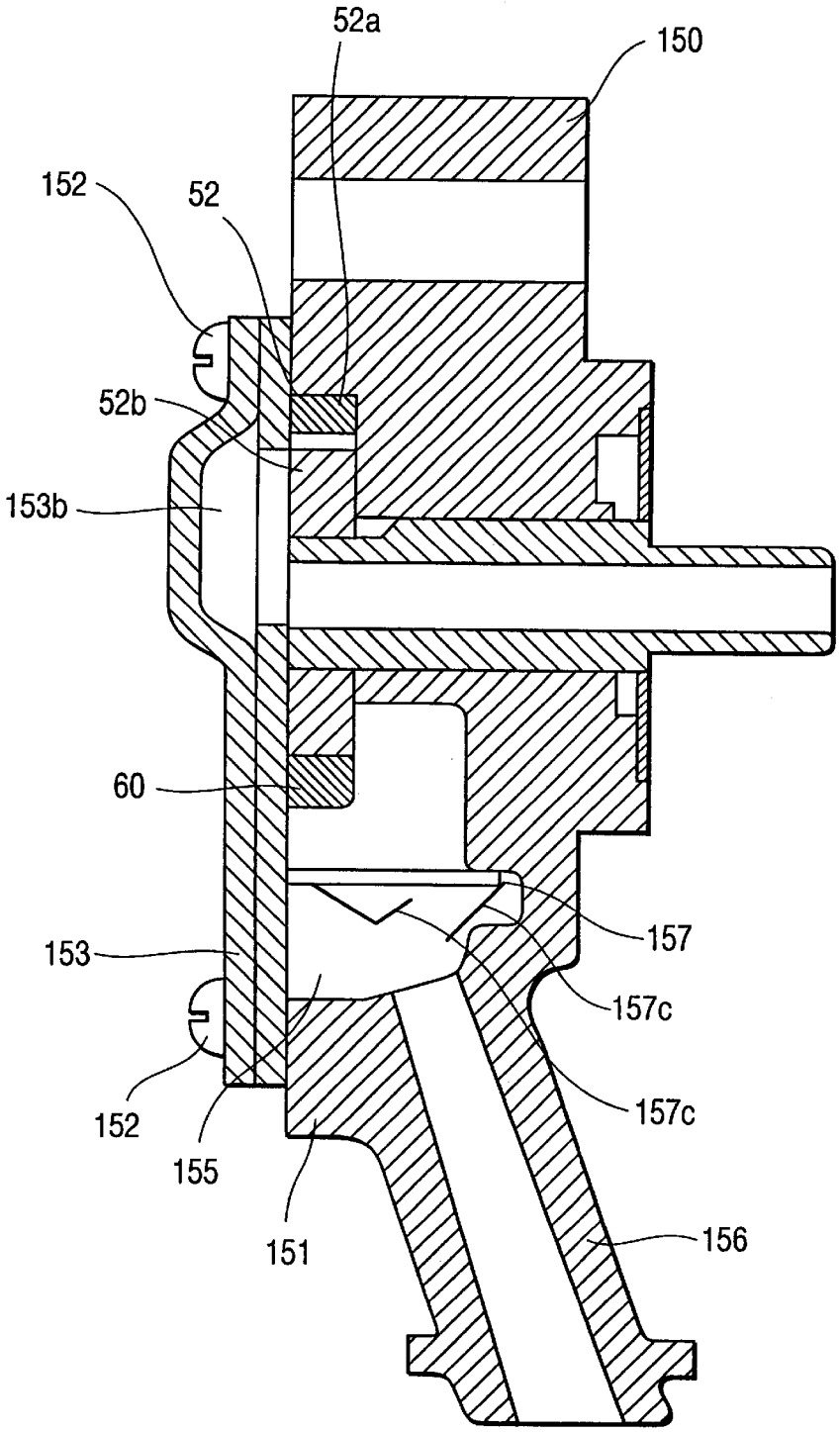
FIG. 16 (PRIOR ART)
FIG. 16 is a vertical sectional view of the conventional gear pump of FIG. 15.

It is to be noted here that although in the above-described embodiments the gear pump 50 has been described as being incorporated in the horizontal type electrically-operated compressor, it can be incorporated in a vertical type electrically-operated compressor by replacing the oil suction nozzle 56 shown in FIG. 1 with a straight oil suction nozzle, as shown in FIG. 13.

It is also to be noted that although in the above-described embodiments the gear pump 50 has been described as comprising an outer gear and an inner gear in mesh with each other, it may comprise two spur gears disposed side by side and being in mesh with each other.

It is further to be noted that although the embodiments shown in FIGS. 1 to 13 are intended for the electrically-operated sealed scroll compressors, the present invention is also applicable to other electrically-operated sealed compressors such as, for example, sealed rotary compressors.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A gear pump for an electrically-operated sealed compressor having a crankshaft, said gear pump comprising:

a pair of gears including a first gear connected to the crankshaft and a second gear in mesh with said first gear; and a substantially flat and substantially oval-shaped component connected by only two screws to a support member in the compressor so as to cover said pair of gears, said substantially flat and substantially oval-shaped component having a major axis and a minor axis.

2. The gear pump of claim 1, wherein said substantially flat and substantially oval-shaped component is asymmetric with respect to one of said major axis and said minor axis.

3. The gear pump of claim 1, wherein said substantially flat and substantially oval-shaped component comprises a pump casing having said pair of gears accommodated therein.

4. The gear pump of claim 3, wherein said substantially flat and substantially oval-shaped component is asymmetric with respect to one of said major axis and said minor axis.

5. The gear pump of claim 1, wherein said substantially flat and substantially oval-shaped component comprises a cover plate for covering said pair of gears.

6. The gear pump of claim 5, wherein said substantially flat and substantially oval-shaped component is asymmetric with respect to one of said major axis and said minor axis.

7. The gear pump of claim 1, wherein said substantially flat and substantially oval-shaped component comprises a pump cover.

8. The gear pump of claim 7, wherein said substantially flat and substantially oval-shaped component is asymmetric with respect to one of said major axis and said minor axis.

9. The gear pump of claim 1, wherein said substantially flat and substantially oval-shaped component comprises a pump casing having said pair of gears accommodated therein, a cover plate for covering said pair of gears, a pump cover, and a sealing material interposed between said pump cover and said cover plate.

10. A gear pump for an electrically-operated sealed compressor having a crankshaft, said gear pump comprising:

a pair of gears including a first gear connected to the crankshaft and a second gear in mesh with said first gear; and a strainer for capturing foreign substances contained in oil to be introduced to said pair of gears, said strainer including a screen having a screen height, said strainer having a substantially round shape and a strainer height, wherein said strainer height is less than a diameter of said strainer, and said strainer height is greater than said screen height.

11. The gear pump of claim 10, further comprising a pump cover for covering said strainer, said strainer being press-fitted into said pump cover and including a press-molded frame secured to said screen.

12. A gear pump for an electrically-operated sealed compressor having a crankshaft, said gear pump comprising:

a pair of gears including a first gear connected to the crankshaft and a second gear in mesh with said first gear; and a strainer for capturing foreign substances contained in oil to be introduced to said pair of gears, said strainer including a screen and a resinous frame injection molded to said screen, said resinous frame being formed of a PBT resin containing 10% to 50% graphite, said frame having a first surface facing said pair of gears, said screen being spaced away from said first surface of said frame.

13. The gear pump of claim 12, wherein said frame has a peripheral surface and includes a plurality of radial projections on said peripheral surface.

14. The gear pump of claim 12, wherein said frame includes at least one reinforcement rib for supporting said screen.

15. The gear pump of claim 12, wherein said frame has a substantially round shape and has at least one radially extending reinforcement rib for supporting said screen.

16. A gear pump for an electrically-operated sealed compressor having a crankshaft, said gear pump comprising:

a pair of gears including a first gear connected to the crankshaft and a second gear in mesh with said first gear;

a cover plate covering said pair of gears;

a pump cover mounted to said cover plate and having peripheral edge and a rib formed on an entire circumference of said peripheral edge so as to extend towards said pair of gears;

a sealing material interposed between said cover plate and said pump cover, wherein said cover plate, said pair of gears, and said sealing material are accommodated in a space formed by said rib.

17. The gear pump of claim 16, wherein said sealing material is substantially flat and substantially oval-shaped.

18. The gear pump of claim 16, wherein said pump cover has a substantially flat and substantially oval-shaped portion.

19. The gear pump of claim 16, wherein said sealing material comprises a sealing member substantially flat and substantially oval-shaped, said sealing member having a major axis and a minor axis and being asymmetrical with respect to one of said major axis and said minor axis.

20. An apparatus comprising:

a compressor including:

a compression mechanism;

an electric motor for driving said compression mechanism; and a crankshaft for transmitting a rotational force of the electric motor to said compression mechanism, said crankshaft having a longitudinal axis and an oil passage extending along said longitudinal axis; and a gear pump including:

a pair of gears including a first gear connected to said crankshaft and a second gear in mesh with said first gear;

a cover plate covering and contacting said pair of gears, said cover plate having an oil communication port extending from a first surface of said cover plate to a second surface of said cover plate, and having an oil passage formed on said second surface for channeling oil from said pair of gears to said oil passage of said crankshaft;

a strainer for capturing foreign substances contained in oil to be introduced to said pair of gears, said strainer including a screen and a frame, said frame having a first surface facing said pair of gears, said screen being spaced away from said first surface of said frame;

a sealing material interposed between said cover plate and said pump cover; and a pump cover mounted to said cover plate, wherein said cover plate, said pair of gears, said strainer, and said sealing material are accommodated within said pump cover.

21. The apparatus of claim 20, further comprising a permanent magnet mounted in said pump cover.

22. The apparatus of claim 20, wherein said cover plate is substantially oval-shaped, and has a major axis and a minor axis, said cover plate being asymmetric with respect to one of said major axis and said minor axis.

23. The apparatus of claim 20, wherein said frame of said screen has a peripheral surface and includes a plurality of radial projections on said peripheral surface.

24. The apparatus of claim 20, wherein said frame of said screen includes at least one reinforcement rib for supporting said screen.

25. A gear pump for an electrically-operated sealed compressor having a crankshaft, said gear pump comprising:

a pair of gears including a first gear connected to the crankshaft and a second gear in mesh with said first gear;

a cover plate covering said pair of gears;

a foreign substance storage compartment provided on a side of said cover plate for storing foreign substances contained in oil to be introduced to said pair of gears, said cover plate being interposed between said pair of gears and said foreign substance storage compartment;

a pump cover mounted to said cover plate and accommodating said foreign substance storage compartment therein; and a permanent magnet mounted in said pump cover.

* * * * *